US006182551B1

(12) United States Patent
Noden

(10) Patent No.: US 6,182,551 B1
(45) Date of Patent: Feb. 6, 2001

(54) WOOD CUTTING APPARATUS

(76) Inventor: Geoffrey W. Noden, 232 Stokes Ave., Trenton, NJ (US) 08638

( * ) Notice: Under 35 U.S.C. 154(b), the term of this patent shall be extended for 0 days.

(21) Appl. No.: 09/301,353

(22) Filed: Apr. 29, 1999

(51) Int. Cl.[7] ..... B26D 5/08
(52) U.S. Cl. ..... 83/609; 83/605; 83/561
(58) Field of Search ..... 83/605, 607, 608, 83/609, 466.1, 561, 559, 695, 699.51

(56) References Cited

U.S. PATENT DOCUMENTS

| | | | | |
|---|---|---|---|---|
| 29,766 | * | 8/1860 | Chichester | 83/608 |
| 158,518 | * | 1/1875 | Phillips | 83/609 |
| 413,522 | * | 10/1889 | Kelsey et al. | 83/468.3 |
| 627,708 | * | 6/1899 | Reeve | 83/561 |
| 1,082,331 | * | 12/1913 | Hopkins et al. | 425/154 |
| 1,184,499 | * | 5/1916 | Wilhermsdorfer | 83/468 |
| 1,830,284 | * | 11/1931 | Massa | 83/608 |
| 2,889,877 | * | 6/1959 | Ralston | 83/607 |
| 3,704,737 | * | 12/1972 | Stout et al. | 83/607 |
| 4,327,618 | * | 5/1982 | Menard | 83/561 |
| 5,103,704 | * | 4/1992 | Spath et al. | 83/466.1 |
| 5,934,166 | * | 8/1999 | Herlihy | 83/605 |

FOREIGN PATENT DOCUMENTS

| | | | | |
|---|---|---|---|---|
| 872567 | * | 6/1971 | (CA) | 83/607 |

* cited by examiner

*Primary Examiner*—M. Rachuba
*Assistant Examiner*—Kim Ngoc Tran
(74) *Attorney, Agent, or Firm*—James A. Wong

(57) ABSTRACT

An apparatus for cutting strips or wafers of wood into contoured pieces for forming an inlay of a desired pattern in a groove of a decorative wooden article, the apparatus comprising a base plate having a work surface with a trough extending thereon; a cutting arm pivotally secured at a first end thereof to the work surface and having an operating handle at a second end thereof, and a member holding a cutting blade on the cutting arm intermediate the handle and the first end, whereby the blade may be raised and lowered by the handle to extend at an angle to and across the trough to effect a cutting operation on strips or wafers of wood placed in the trough in a cutting zone; and first and second fixed stop members disposed in the trough on opposite sides of the cutting arm at predetermined distances from the cutting zone so that a strip or wafer of wood may be placed thereagainst with a portion extending to the cutting zone for an initial cut; and wherein the blade has a multi-planar cutting surface to facilitate contour cutting of wafers placed thereunder.

20 Claims, 5 Drawing Sheets

WOOD CUTTING APPARATUS

BACKGROUND OF THE INVENTION 1. Field of the Invention

The present invention relates to a new and improved wood cutting apparatus. More particularly, this invention relates to an apparatus on which relatively thin wafers or strips of wood may be fed in guided manner under a cutting blade and thereby cut in various contoured pieces, which in turn are inlaid together to form various desired patterns in an art known as marquetry. 2. Description of the Prior Art Heretofore the practioner of marquetry, that is the art of inlaying with wood, has used a fine saw to cut out veneers for inlaying. The saw is mounted in a bow or arched handle, and worked in short quick movements, sometimes to cut three or four veneers simultaneously. Inlaying is practiced sometimes by the use of woods of different colors, grain structure, and the like; sometimes by the use of wood cut to different contours or shapes, but having complementary edges so as to allow for interfitting; and sometimes by the use of woods to both different contours and from woods of contrasting colors and/or grain structure to provide both interesting and attractive products. For example, to obtain a finished product with contrasting colors, a dark wood may be used in combination with a tulip-wood or to obtain a product with contrasting color and grain structure, use of holly and walniat provides an attractive product. Subsequent to conceiving the present invention, applicant caused a prior art search for relevant prior art to be conducted in the United States Patent Office. In the course of the search the patents listed below, which constitute the most relevant art noted, are brought to the attention of the Examiner to be assigned to examine this application:

| Patent No. | Patentee | Year | Class/Subclass |
|---|---|---|---|
| 116,258 | Bean, Jr. | 1871 | 83/607 |
| 291,509 | Gratz et al | 1884 | 83/468 |
| 1,090,297 | Greenwell | 1914 | 83/468 |
| 1,149,942 | Perez | 1915 | 83/468 |
| 1,184,499 | Wilhemsdorfer | 1916 | 83/468 |
| 1,462,871 | Rosenberg | 1923 | 83/468 |
| 2,889,877 | Ralston | 1959 | 83/607 |
| 3,134,285 | Greene | 1964 | 83/468.3 |
| 4,346,636 | Taylor | 1982 | 83/468.3 |
| 4,580,474 | Bueche, Sr. | 1986 | 83/468 |
| 5,249,495 | Renk | 1993 | 83/468.3 |
| 5,259,284 | Chen | 1993 | 83/468.3 |
| 5,297,463 | O'Banion et al | 1994 | 83/468.3 |

Considering the art cited above, it is appears that paper cutting type or Guillotine apparatuses, which on first blush, might seem to be suitable for use to achieve the objectives attained by the present invention, include those disclosed in U.S. Pat. Nos. 291,509; 2,889,877; and 5,249,495. To produce the desired contoured pieces on such apparatuses, as disclosed in the cited patents, requires considerable skill, dexterity, attention, and determination on the part of the operator in manipulating, holding, and feeding the wafer or strip of wood to the respective cutting members of the prior art. The apparatuses of the cited patents, while possessing some structural features enabling cutting action, which merely remotely resemble that of the present invention, but owing to deficiencies in their structural details and arrangements, they fall far short of the mark of enabling one to turn out the desired contoured pieces as efficiently and neatly as the present invention does.

The patents listed above, which constitute the most relevant art known by applicant with respect to the disclosed invention, relate to cutting apparatuses having structural details generally similar to several components of the subject matter for which a patent is sought. Such details of the prior art, however, neither anticipate nor render obvious the apparatus disclosed herein.

SUMARY OF THE INVENTION

The present invention provides an apparatus whereby an artisan of average skill and knowledge may, consistent with the intended objectives of the disclosed invention, readily put it to use in cutting relatively thin wafers or strips of wood into various contoured pieces for forming decorative patterns, for example, in an inlaying procedure to provide a decorative work of art. As noted above, in the practice of inlaying with wood, the artisan has, heretofore had to cut the pieces of inlay members by hand with a saw, which needless to say can turn out to be quite tedious. This application relates to a new and improved apparatus for cutting a plurality of contoured pieces of wood for forming an inlay of a desired pattern in a groove of a decorative wooden member from thin strips or wafers of end grain portions of hard wood. While commercially developed versions of such prior art devices are unknown to applicant for whatever reason, whether it be due to inherent deficiencies or other shortcomings thereof, the present invention has been developed to avoid the shortcomings of the prior art devices and meet the longfelt need therefor.

A principal object of the present invention is to provide a new and improved apparatus for cutting contoured pieces of wood for forming an inlay of a desired pattern in a groove of a decorative wooden member from thin strips or wafers of end grain portions of hard wood.

It is another object of the invention to provide a new and improved apparatus for cutting a plurality of contoured pieces of wood for forming an inlay of a desired pattern in a groove of a decorative wooden member from thin strips or wafers of end grain portions of hard wood.

It is also an object of this invention to provide a new and improved apparatus which requires less handling and manipulation of the stock material to be fed to the cutting element to produce contoured pieces of wood for forming an inlay of a desired pattern in a groove of a decorative wooden member from thin strips or wafers.

It is further an object of the present invention to provide an improved apparatus which effects greater operator safety in requiring less handling and manipulation of the stock material to be fed to the cutting element in producing contoured pieces of wood for forming an inlay of a desired pattern in a groove of a decorative wooden member from thin strips or wafers.

Other objects and advantages of the present invention will be readily discernible to the reader upon closer examination of the following description taken in conjunction with the accompanying drawings.

BRIEF DESCRIPTION OF THE DRAWINGS

Referring briefly to the drawings, the reader will readily visualize the various embodiments of the present invention wherein.

DETAILED DESCRIPTION OF THE INVENTION

Figure 1:
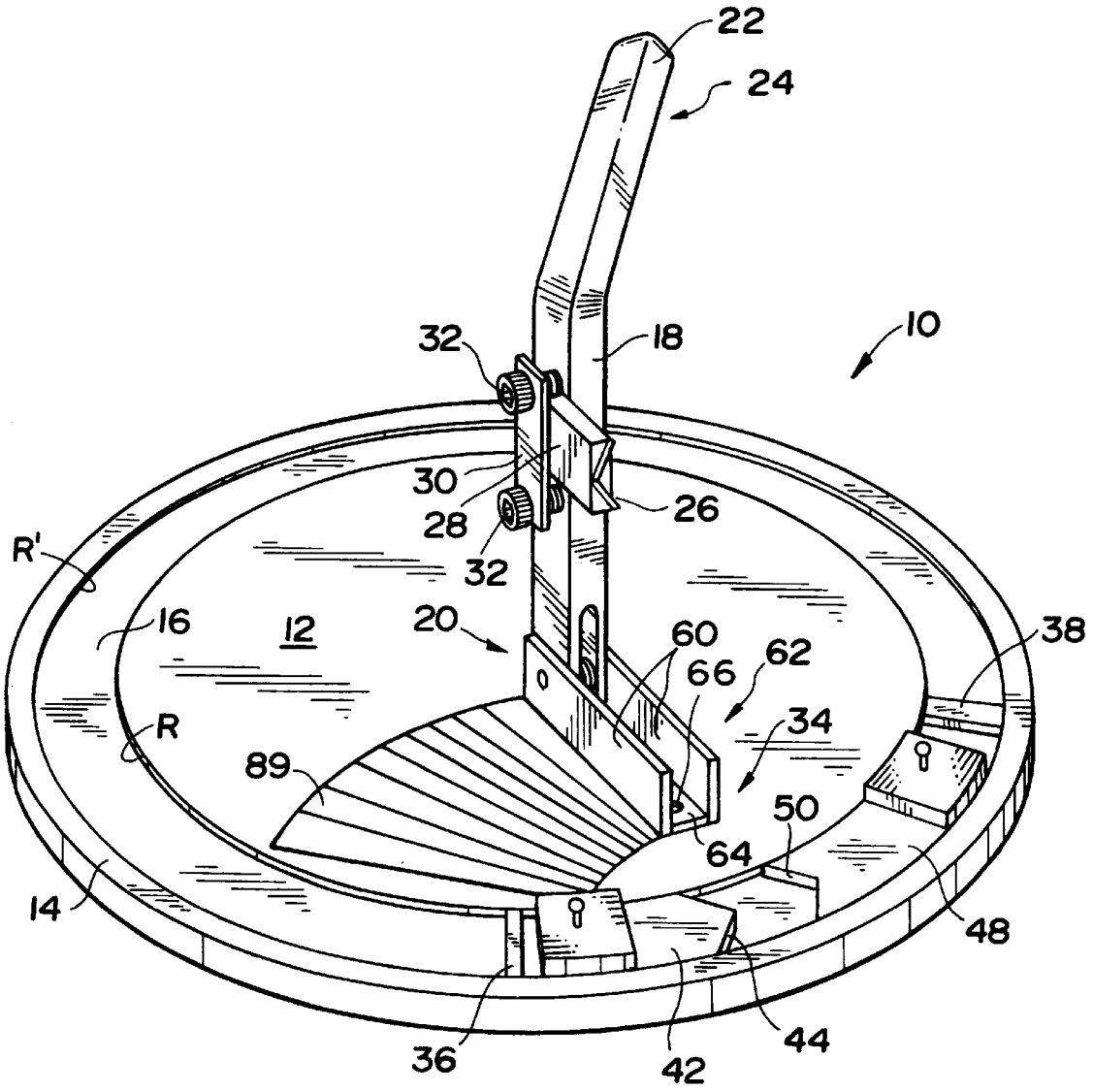
FIG. 1 represents a view in perspective of the cutting apparatus according to the present invention showing the various components thereof.
Figure 2:
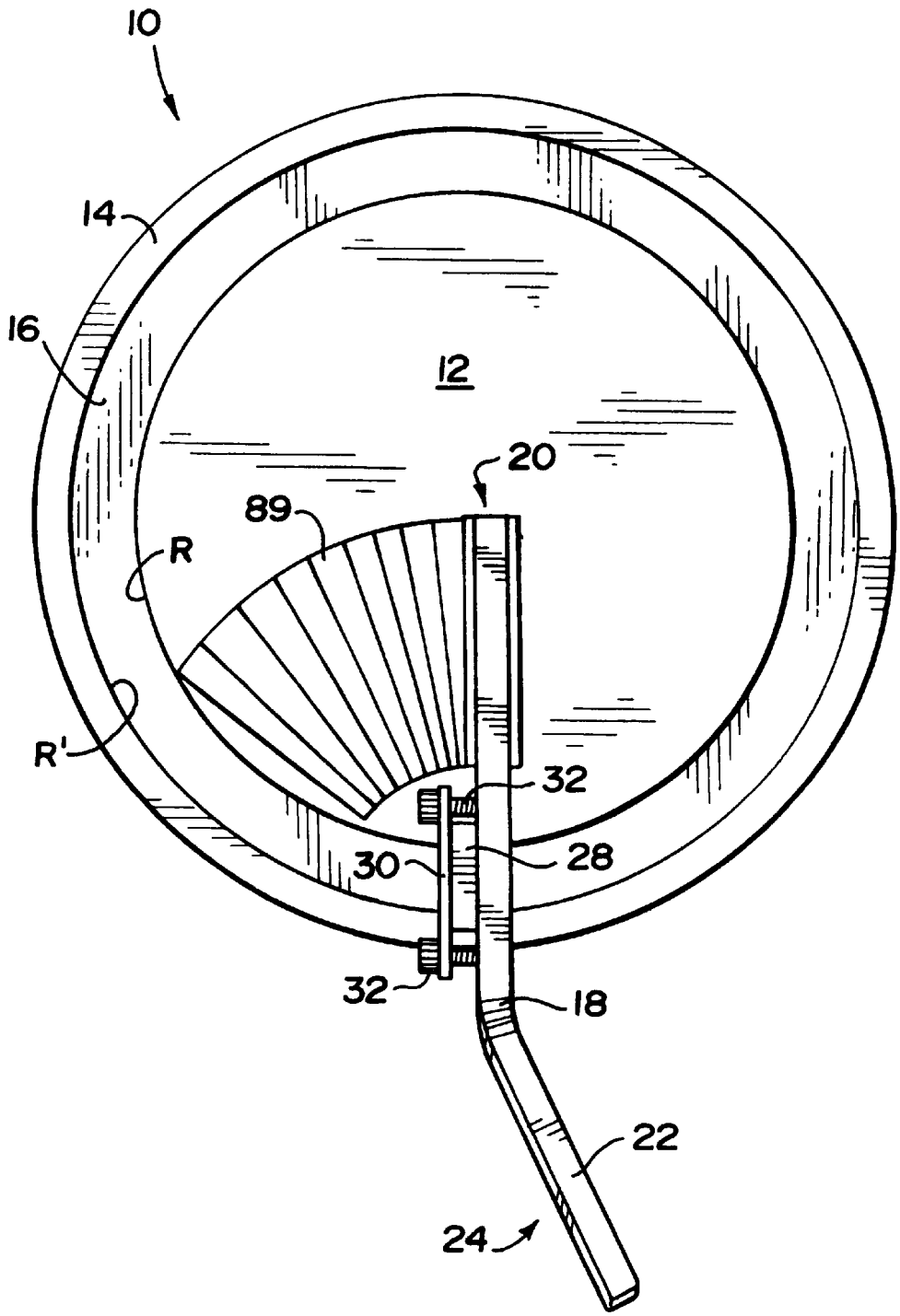
FIG. 2 shows a top plan view of the present invention with the operating handle lowered to the position with the cutting blade in the cutting zone.
Figure 3:
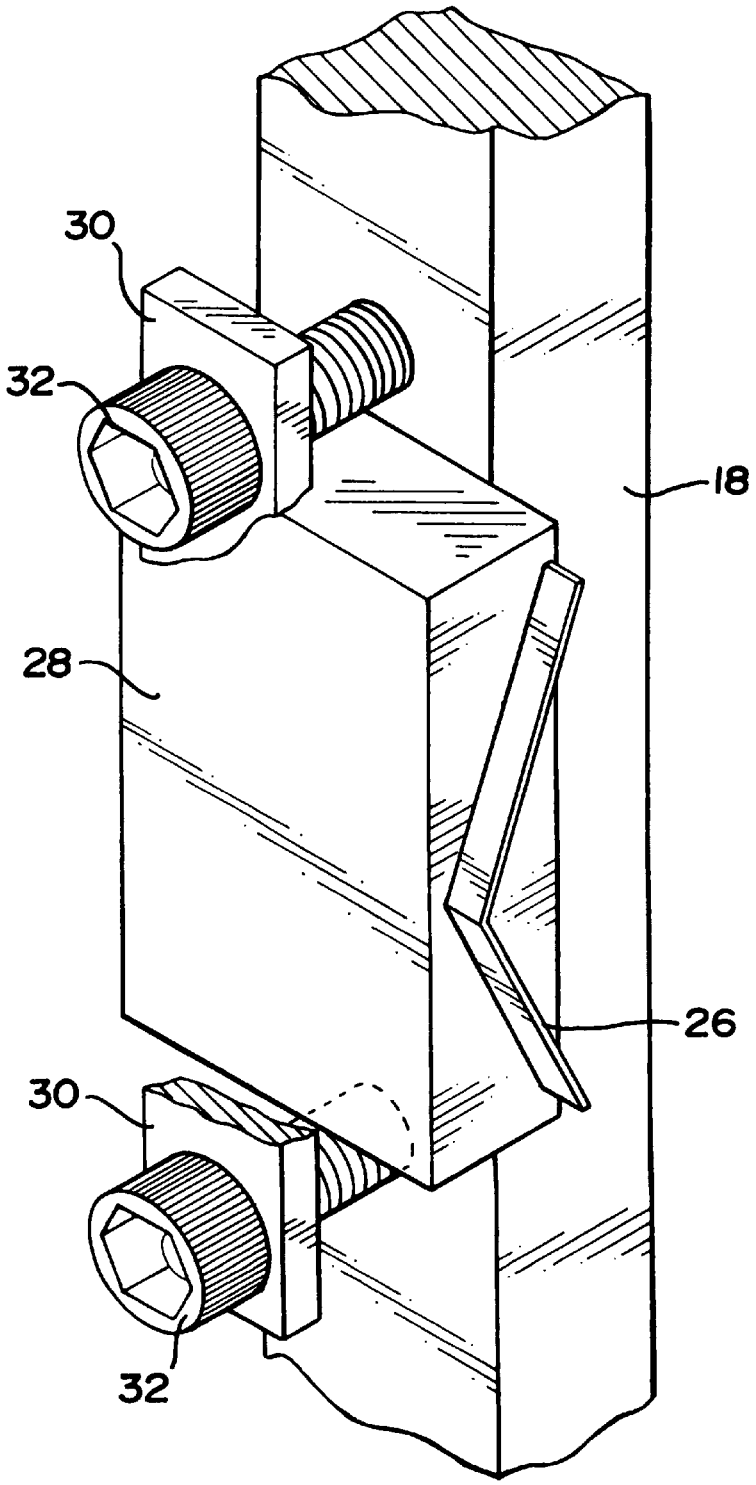
FIG. 3 shows on an enlarged scale and in perspective a cutting blade for use in the present invention to better disclose details thereof.
Figure 4:
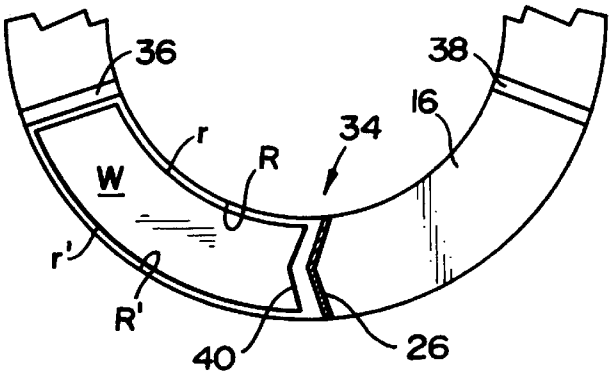
FIG. 4 represents a plan view of the cutting zone with the blade making an initial cut on a blank to form an inlay member.

Referring now to the drawings with greater attention to details thereof, the reader will readily appreciate from FIGS. 1–3 that the inventive concept disclosed and claimed herein relates to a new and improved cutting apparatus 10 for cutting strips or wafers W of wood into contoured pieces for forming an inlay of a desired pattern in a groove of a decorative wooden article. The cutting apparatus 10 comprises a base plate 12 having a work surface 14 with a trough 16 extending thereon, a cutting arm 18 pivotally secured at a first end 20 thereof to work surface 14. An operating handle 22 extends from a second or opposite end 24 of cutting arm 18 with cutting blade 26 in turn extending from one edge of a block or plate assembly 28 removably secured to cutting arm 18 by clamp 30 and bolts 32 intermediate handle 22 and first end 20. Thus, blade 26 may be raised and lowered by handle 22 to extend at an angle to and across trough 16 between positions illustrated in FIGS. 1 and 2 to effect cutting strokes on strips or wafers W of wood placed in trough 16 and fed into cutting zone 34 between first and second fixed stop members 36, 38, respectively, disposed in trough 16 on opposite sides of cutting arm 18 at predetermined distances from cutting zone 34 so that a strip or wafer W of wood may be placed against either fixed stop members 36, 38 with a portion of the strip or wafer W extending to cutting zone 34 for an initial cut as seen in FIG. 4. Any scrap on the right of blade 26 may be discarded.

Figure 8:
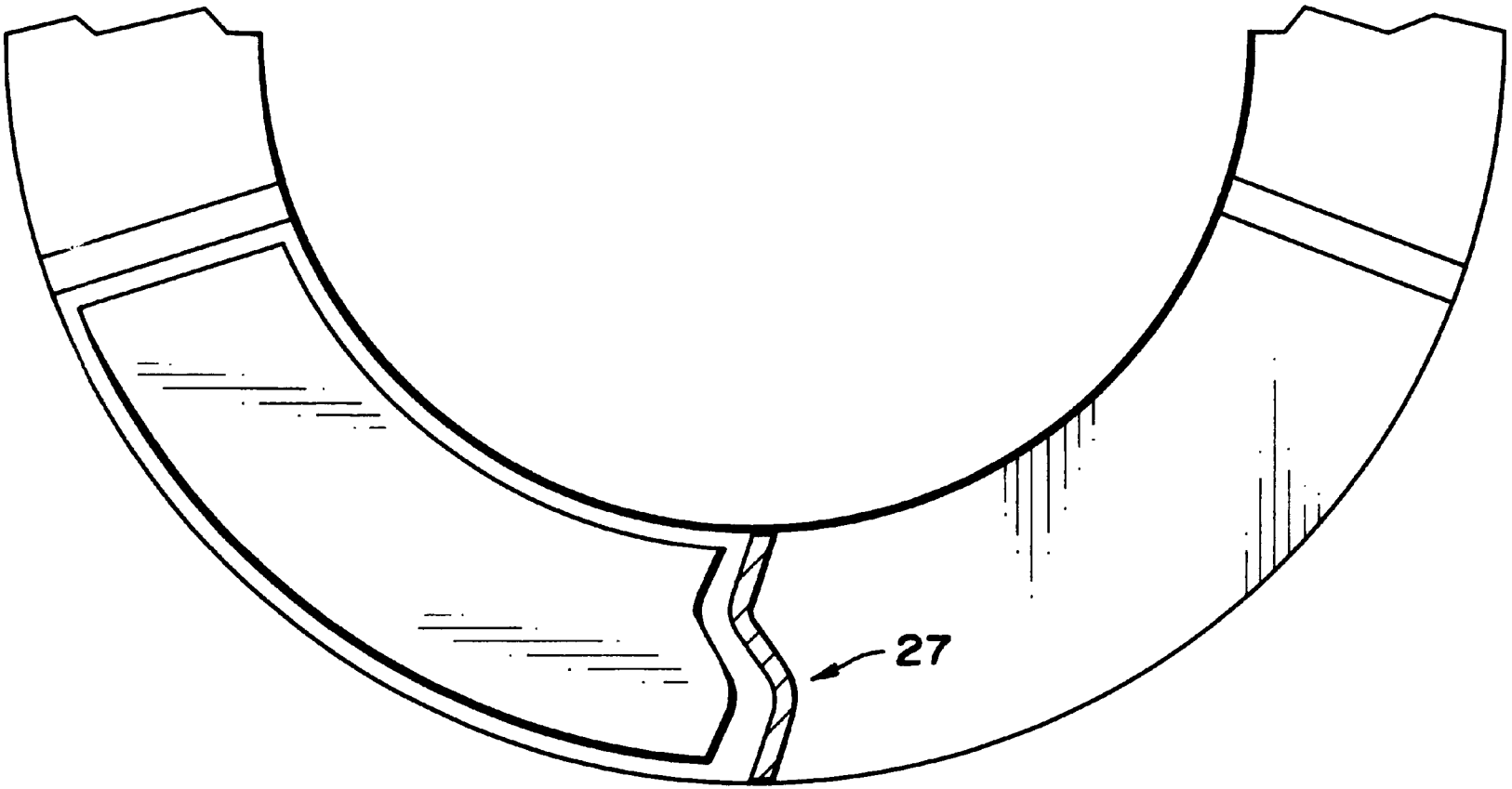
FIG. 8 represents a plan view of an alternative form of a cutting blade for use in the disclosed cutting apparatus.

As may be clearly seen in FIGS. 1 and 3, blade 26 has a multi-planar cutting edge to facilitate contour cutting of wafers W placed thereunder. It is also seen that while cutting arm 18 and cutting blade 26 are in radial alignment with the circular formation of base plate 12 so that blade 26 extends over trough 16 to cut at right angles thereto, the orientation of cutting arm 18 and blade 26 may be changed as will be described hereinbelow. While the multi-planar surface of blade 26 is shown with the configuration of the letter V, it may, optionally, be of other configurations, such as the sinuous configuration in plan view of blade 27 in FIG. 8. Also, while FIGS. 1 and 2 show trough 16 extending along a curvilinear or circular path, this trough may optionally extend, instead, along a generally linear path.

Figure 5:
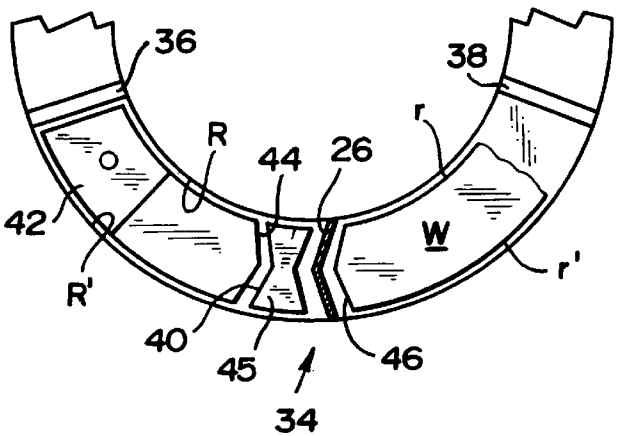
FIG. 5 represents the second cut on a blank to form an inlay member started in FIG. 4 and the first cut of a second inlay member.

Considering now FIGS. 1 and 4, the reader seeing the attitude of blade 26 with its vertex pointing to the left, will appreciate that a wafer W of wood, preformed with both inner and outer radii r, r' conforming to corresponding inner and outer radii R, R', respectively, of trough 16 and with predetermined circumferential length, placed in trough 16 with its trailing end against fixed stop member 36 on the left of zone 34, will have its other end protruding into cutting zone 34 for a first pass by blade 26 lowered therethrough, resulting in wafer W having a first cut end 40 as one side of an hour glass cutout. To obtain a complete hour glass cutout, a first movable stop member 42 is placed with one end against fixed stop member 36 and wafer W is turned end over end and placed with cut end 40 against movable stop member 42, which has a complementary half diamond edge 44 to accommodate first cut end 40 and a predetermined length to effect cutting hour glass shaped pieces 45 from the portion of wafer W extending on the opposite side of blade 26 in cutting zone 34 on a second pass of blade 26 as shown in FIG. 5 and remaining wafer W with a half diamond edge 46, which constitutes the first cut half of a diamond shape cutout, on the right side of cutting zone 34. It is to be understood that all operations are carried out with inner radius r of wafer W placed against inner radius R of trough 16 and with outer radius r' of wafer W placed against outer radious R' of trough 16.

Figure 6:
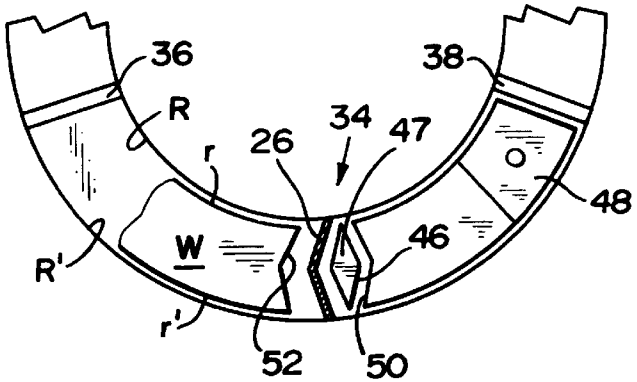
FIG. 6 represents the second cut on a blank to form the second inlay member and the first cut of a third inlay member.
Figure 7:
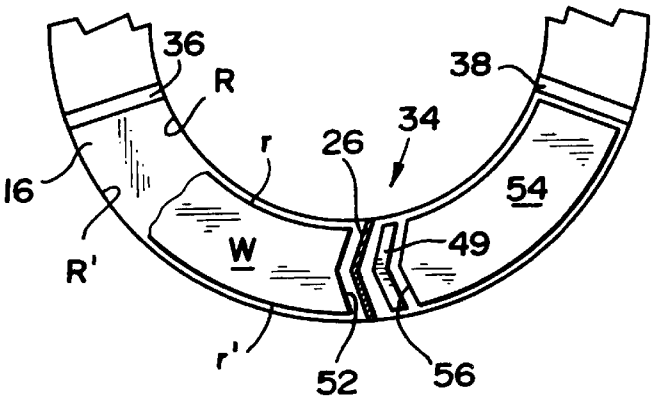
FIG. 7 represents the second cut on a blank to form a third inlay member started in FIG. 6.

Also, to obtain a complete diamond shape cutout, second movable stop member 48 is placed in trough 16 against fixed stop member 38 on the right side of blade 26 and wafer W is turned end over end and placed with cut end 46 against movable stop member 48, which has a complementary half hour glass edge 50 to accommodate first cut half diamond edge 46 and a predetemined length to enable cutting diamond shaped pieces 47 from the portion of wafer W on the opposite side of blade 26 in cutting zone 34 on the second pass of blade 26 as shown in FIG. 6 and remaining wafer W with a half hour glass edge 52, which forms the first cut half of the next hour glass cutout, on the left side of the cutting zone 34. Again, all operations are conducted with inner radius r of wafer W placed against inner radius R of trough 16 and with outer radius r' of wafer W placed against outer radius R' of trough 16.

Since, as described above after completion of a cutout of an hour glass configuration, the remaining wafer W has a half diamond contour end and conversely after the completion of a cutout of a diamond configuration, the remaining wafer W has a half hour glass contour end, the artisan may alternately cut out hour glass shapes and diamond shapes in succession or may work continuously on one or the other side of the cutting blade 26 over various periods of time to produce only hour glass shapes or only diamond shapes by using a succession of different wafers or blanks. With the blade set up described above for producing hour glass and diamond cutouts, it is also possible to produce chevron shape cutouts on the present invention, since a chevron can be seen to be a thin slice of a diamond cutout or of an hour glass shape cutout. With the foregoing in mind, a third movable stop member 54 is used in combination with fixed stop member 38 on the right of cutting zone 34, to take advantage of the leftover half of an hour glass on the end of wafer W to cut thin sections 49 of chevron shape cutouts. In this case, the half hour glass edge of wafer W is placed against third movable stop member 54 which has a complementary half diamond edge 56 to accommodate the end of the wafer W and also has such circumferential width as to allow a slight projection of the end of wafer W on the right of blade 26 and the larger portion of wafer W on the left of blade 26 so that chevron cutouts 49 may be produced thereat. In this manner numerous chevron pieces 49 can be quickly cut, simply by repeatedly moving wafer W against movable stop member 54 after each cutting stroke of blade 26.

Cutting arm 18 is also shown to be pivotally secured and supported on and between upwardly extending flanges 60 of sheathe 62 for cutting arm 18. Flanges 60 extend from a cross-piece 64 having detachable securing members 66, one of which can be seen in FIG. 1. As is clear from FIGS. 1 and 2 cutting arm 18 extends along a diameter of base plate 12 so that blade 26 will pass through cutting zone 34 at right angles to trough 16 and may be selectively relocated along any of the various lines on index guide 89 so that blade 26 may cut at various angles with respect to trough 16. As shown in FIGS. 1 and 2, trough 16 extends along a circular path having an inner radius R and an outer radius R' to ensure that wafers W preformed with corresponding inner radius r and outer radius r' so as to conform therewith will be guided and controlled during cutting operations made thereon by cutting apparatus 10, so that contoured pieces thus produced can be neatly and accurately fitted within a similarly sized groove and will form an attractive pattern of inlaid pieces of various contours.

It will be obvious to those skilled in the art that various changes may be made without departing from the scope of the invention; and therefore, the invention is not to be limited to what is shown in the drawings and described in the specification, but only as indicated in the appended claims.

What is claimed is:

1. An apparatus for cutting wafers of wood into contoured pieces for forming an inlay of a desired pattern in a groove of a decorative wooden member, said apparatus comprising:

a. a base plate having a work surface with a circular trough extending thereon;

b. a cutting arm pivotally secured at a first end thereof to said work surface and having an operating handle at a second end thereof, and means holding a blade on said cutting arm intermediate said operating handle and said first end, whereby said blade may be raised and lowered by said handle to extend at an angle to and across said trough to effect a cutting operation on wafers of wood placed in said trough in a cutting zone; and c. first and second fixed stop means disposed in said trough on opposite sides of said cutting arm at predetermined distances from said cutting zone so that a wafer of wood may be placed thereagainst with a portion extending to said cutting zone for an initial cut; and wherein said blade has a multi-planar cutting surface to facilitate contour cutting of wafers placed thereunder.

2. An apparatus for cutting wafers as defined in claim 1 and movable stop means in combination with one of said first and second fixed stop means for effecting a cutting of a contoured inlay piece after two passes of said blade over a wafer and wherein said movable stop means is of such dimension that said inlay piece is cut in the shape of a chevron.

3. An apparatus for cutting wafers as defined in claim 1 and movable stop means in combination with one of said first and second fixed stop means for effecting a cutting of a contoured inlay piece after two passes of said blade over a wafer and wherein said movable stop means is of such dimension that said inlay piece is cut in the shape of an hour glass.

4. An apparatus for cutting wafers as defined in claim 1 and movable stop means in combination with one of said first and second fixed stop means for effecting a cutting of a contoured inlay piece after two passes of said blade over a wafer and wherein said movable stop means is of such dimension that said inlay piece is cut in the shape of a diamond.

5. An apparatus for cutting wafers of wood into contoured pieces for forming an inlay of a desired pattern in a groove of a decorative wooden member, said apparatus comprising:

a. a base plate having a work surface with a trough extending thereon;

b. a cutting arm pivotally secured at a first end thereof to said work surface and having an operating handle at a second end thereof, and means holding a cutting blade on said cutting arm intermediate said operating handle and said first end, whereby said blade may be raised and lowered by said handle to extend at an angle to and across said trough to effect a cutting operation on wafers of wood placed in said trough in a cutting zone; and c. first and second fixed stop means disposed in said trough on opposite sides of said cutting arm at predetermined distances from said cutting zone so that a wafer of wood may be placed thereagainst with a portion extending to said cutting zone for an initial cut; and wherein said blade has a multi-planar cutting surface to facilitate contour cutting of wafers placed thereunder.

6. An apparatus for cutting wafers as defined in claim 5, wherein said cutting blade extends over said trough at right angles thereto.

7. An apparatus for cutting wafers as defined in claim 5, wherein said trough extends along a generally linear path.

8. An apparatus for cutting wafers as defined in claim 5, wherein said trough extends along a curvilinear path.

9. An apparatus for cutting wafers as defined in claim 5, wherein said trough extends along a circular path.

10. An apparatus for cutting wafers as defined in claim 5, wherein said multi-planar surface of said blade has the configuration of the letter V.

11. An apparatus for cutting wafers as defined in claim 5, wherein said multi-planar surface of said blade appears has a sinuous configuration in a plan view thereof.

12. An apparatus for cutting wafers as defined in claim 5 and movable stop means in combination with one of said first and second fixed stop means for effecting a cutting of a contoured inlay piece after two passes of said blade over a wafer and wherein said movable stop means is of such dimension that said contoured inlay piece is cut in the shape of a chevron.

13. An apparatus for cutting wafers as defined in claim 5 and movable stop means in combination with one of said first and second fixed stop means for effecting a cutting of a contoured inlay piece after two passes of said blade over a wafer and wherein said movable stop means is of such dimension that said contoured inlay piece is cut in the shape of an hour glass.

14. An apparatus for cutting wafers as defined in claim 5 and movable stop means in combination with one of said first and second fixed stop means for effecting a cutting of a contoured inlay piece after two passes of said blade over a wafer and wherein said movable stop means is of such dimension that said contoured inlay piece is cut in the shape of a diamond.

15. An apparatus for cutting wafers as defined in claim 5, wherein said cutting arm is supported on and between upwardly extending flanges of a sheathe for said cutting arm, said upwardly extending flanges extending from a cross-piece having detachable securing means for selectively securing said cutting arm so that said blade will cut at various angles with respect to said trough.

16. An apparatus for cutting wafers as defined in claim 15 in combination with indicia means for locating and orienting said detachable securing means to selectively secure said cutting arm at selective locations on said base plate and in selective angles with respect to said trough.

17. An apparatus for cutting wafers of wood into contoured pieces for forming an inlay of a desired pattern in a groove of a decorative wooden member, said apparatus comprising:

a. a base plate having a work surface with a circular trough extending thereon;

b. a cutting arm pivotally secured at a first end thereof to said work surface and having an operating handle at a second end thereof, and means holding a cutting blade on said cutting arm intermediate said operating handle and said first end, whereby said blade may be raised and lowered by said handle to extend at an angle to and across said trough to effect a cutting operation on wafers of wood placed in said trough in a cutting zone; and c. first and second fixed stop means disposed in said trough on opposite sides of said cutting arm at predetermined distances from said cutting zone so that a wafer of wood may be placed thereagainst with a portion extending to said cutting zone for an initial cut; and wherein said blade has a multi-planar cutting surface in the configuration of the letter V to facilitate contour cutting of wafers placed thereunder.

18. An apparatus for cutting wafers as defined in claim 17 and movable stop means in combination with one of said first and second fixed stop means for effecting a cutting of a contoured inlay piece after two passes of said blade over a wafer and wherein said movable stop means is of such dimension that said contoured inlay piece is cut in the shape of a chevron.

19. An apparatus for cutting wafers as defined in claim 17 and movable stop means in combination with one of said first and second fixed stop means for effecting a cutting of a contoured inlay piece after two passes of said blade over a wafer and wherein said movable stop means is of such dimension that said contoured inlay piece is cut in the shape of an hour glass.

20. An apparatus for cutting wafers as defined in claim 17 and movable stop means in combination with one of said first and second fixed stop means for effecting a cutting of a contoured inlay piece after two passes of said blade over a wafer and wherein said movable stop means is of such dimension that said contoured inlay piece is cut in the shape of a diamond.

* * * * *